United States Patent [19]

Baur et al.

[11] Patent Number: 5,067,832

[45] Date of Patent: Nov. 26, 1991

[54] EXPANDABLE MODULE FRAME FOR MOUNTING PRINTER AND ACCESSORY MODULES

[75] Inventors: Rupert Baur, Villingen; Egon Durler, Mönchweiler; Hermann Kilb, Brigachtal, all of Fed. Rep. of Germany

[73] Assignee: Mannesmann Aktiengesellschaft, Düsseldorf, Fed. Rep. of Germany

[21] Appl. No.: 515,078

[22] Filed: Apr. 26, 1990

Related U.S. Application Data

[63] Continuation-in-part of Ser. No. 148,318, Jan. 27, 1988, abandoned.

[30] Foreign Application Priority Data

Jan. 27, 1987 [DE] Fed. Rep. of Germany ..... 3702270

[51] Int. Cl.[5] ..... B41J 5/30

[52] U.S. Cl. ..... 400/66; 400/73; 400/78; 400/82; 400/584; 400/692; 400/693; 400/586; 400/593; 361/393; 361/394; 361/395

[58] Field of Search ..... 400/692, 693, 584, 4, 400/61, 66, 73, 76, 78, 82, 88, 586, 593; 361/393, 394, 390, 391, 392, 395

[56] References Cited

U.S. PATENT DOCUMENTS

| | | | |
|---|---|---|---|
| 3,940,758 | 2/1976 | Margolin | 400/78 |
| 4,027,765 | 6/1977 | Crump et al. | 400/584 |
| 4,039,069 | 8/1977 | Kwan et al. | 400/73 |
| 4,217,624 | 8/1980 | Tuck | 361/394 |
| 4,381,705 | 5/1983 | Roes et al. | 401/66 |
| 4,527,285 | 7/1985 | Kekas et al. | 361/393 |

(List continued on next page.)

FOREIGN PATENT DOCUMENTS

| | | | |
|---|---|---|---|
| 0195949 | 10/1986 | European Pat. Off. | 400/82 |
| 4255427 | 2/1988 | European Pat. Off. | 400/105 |
| 2232590 | 8/1980 | Fed. Rep. of Germany . | |
| 2915720 | 10/1980 | Fed. Rep. of Germany . | |
| 3039124 | 2/1982 | Fed. Rep. of Germany | 400/73 |
| 3309115 | 9/1984 | Fed. Rep. of Germany | 400/692 |
| 3403414 | 8/1985 | Fed. Rep. of Germany | 400/692 |
| 3445908 | 6/1986 | Fed. Rep. of Germany | 400/692 |
| 0123564 | 6/1986 | Japan | 400/54 |
| 2109137 | 5/1983 | United Kingdom | 400/82 |
| 2133222 | 7/1984 | United Kingdom | 361/391 |

OTHER PUBLICATIONS

Hill et al., "Selfcontained . . . Reader/encoder", IBM Tech. Disc. Bulletin, vol. 20, No. 5 pp. 1879–1880; 10/77.

"Personal Computer . . . Manufacturability", IBM Tech. Disc. Bulletin, vol. 30, No. 3, pp. 1253–1255, 8/87.

"Interface/Tailgate Assembly" IBM Tech. Disclosure Bulletin, vol. 27, No. 9, 2/85, p. 5327.

"Modular Printing Station" IBM Technical Disclosure Bulletin, vol. 22, No. 2, 1/79, p. 727–729 7/79.

*Primary Examiner*—Eugene H. Eickholt

*Attorney, Agent, or Firm*—Horst M. Kasper

[57] ABSTRACT

A printer for a plurality of different printing objects serving as a multifunctional printer is subject to problems of economic production. A printer system which allows to process all internationally required forms and savings booklets, records, checks, protocols, driver licenses for motor vehicles, passports, identification cards, motor vehicle registration papers, picture-text BTX texts, and teletext texts, can be furnished, depending on the selected functions, by forming a base model (1), which includes a print apparatus (2), a print-object transport device (3), an operating field (4), an electronic control device (5), and a power supply (6), where the print apparatus (2), the power supply (6), and the electronic control device (5) form in each case modular building blocks (7), which can be easily mounted and easily demounted by receiving and bolting means (8, 10 or, respectively, 9*a*, 10*a*) disposed at a base frame (8) and where further receiving and bolting means (9, 10 or, respectively, 9*b*, 10*b*) are provided at the base frame (8) for an optical character-recognition device (15) and/or for a magnetic-strip processing (20) and/or for an optical line searcher (21) and/or for an optical marking searching (22) and/or for a journal-printer modular building block (23, 7).

24 Claims, 14 Drawing Sheets

U.S. PATENT DOCUMENTS 4,531,852 7/1985 Madge ..... 400/82
4,561,352 12/1985 Svyatsky et al. ..... 400/82
4,669,029 5/1987 Svenson et al. ..... 361/392
4,671,686 6/1987 Howes et al. ..... 400/692
4,695,171 9/1977 Sapitowicz ..... 400/73
4,706,096 11/1987 Sato ..... 400/73
4,722,620 2/1988 Igi et al. ..... 400/73
4,730,947 3/1988 Iueda et al. ..... 400/692
4,732,502 3/1988 Youol ..... 400/692
4,734,710 3/1988 Sato et al. ..... 400/73
4,746,233 5/1988 Osnwa et al. ..... 400/73
4,788,658 11/1988 Hanebuth ..... 400/691
4,812,060 3/1989 Pailler ..... 400/82

19
27
29
8
8b
8a
31
30

EXPANDABLE MODULE FRAME FOR MOUNTING PRINTER AND ACCESSORY MODULES

CROSS-REFERENCE TO RELATED APPLICATIONS

This application is a continuation-in-part application of another application filed Jan. 27, 1988 and bearing Ser. No. 148,318 now abandoned. The entire disclosure of this latter application, including the drawings thereof, is hereby incorporated in this application as if fully set forth herein.

BACKGROUND OF THE INVENTION

1. Field of the Invention

The invention relates to a printer for a plurality of different printing objects which can include documents, checks, savings booklets, protocols, forms of all kinds such as, for example, biiis, receipts, driver licenses, passports, identification cards, motor vehicle documents, both picture BTX texts (hardcopy) as well as teletex TTX texts.

2. Brief Description of the Background of the Invention Including Prior Art

Such printing objects, which can be processed by conventional printing machines, comprise numerous purposes and include receipt slips produced by roller strips. Such printers are employed in banks, financial institutions, post offices, municipal administrations, and governmental authorities and offices of all kinds, in commercial enterprises, in cooperatives, and in general commercial activities.

Such multifunctional printers are subject to big problems with respect to their economic production, Printers for individual functions are known. For example, savingsbooklet printers are produced which are naturally deemed to be a specialty printer. In addition, there exist ticket printers, which are also considered specialty printers. It is understood that a printer with several functions becomes less favorable in production and economics the higher the number of functions increases. Difficulties occur in case of multifunctional printers in addition by the special form of the objects to be printed on, since there exist large varieties with regard to thickness, stiffness, quality, and irregularity of cut, in case of savings booklets, driver licenses, passports, identification cards, and motor vehicle documents, which impose limits in the processing.

On the other hand, the market not always requires the highest number of functions such that the selection of functions has to be performed already in the planning of the production in the production plant. Thus, the problem of the multifunctional printer is substantially a problem of the construction and of the production economy.

It is known from German Patent No. 3,208,111 to provide a printing device of modular construction, where the printer apparatus can be tilted around a hinge between one position where an individual form or, respectively, a set of forms is being printed on, and one position where an endless form or, respectively, a set of endless forms is being printed on. It is known in this context to form the individual-form transport modular as a removable base apparatus and it is further known to form the printer apparatus and the endless-form transport in a foldable way. Such a construction, however, does not resolve the problem to provide to the printer a larger number of functions, which are taken into consideration already at the time of construction and production planning and not only during the use of the printer.

SUMMARY OF THE INVENTION

1. Purposes of the Invention

It is an object of the present invention to provide a printer system which allows the processing of all international required forms and savings booklets, receipts, checks, protocols, driver licenses for motor vehicles, passports, identification cards, motor vehicle registration papers, picture-text BTX texts, and teletext texts, depending on the number of desired functions.

It is a further object of the invention to provide a printer which can receive attachments appropriate for the printing material to be used.

It is a further object of the present invention to provide a modular printer which allows easy disassembly and removal of modules for an economic maintenance.

These and other objects and advantages of the present invention will become evident from the description which follows.

2. Brief Description of the Invention

According to the invention a printer for a plurality of different print substrate material processing functions comprises a base frame. A print apparatus forms a modular building block and is demountably attached to the base frame. A print substrate material transport device is disposed on the base frame. A keyboard is attached to the base frame for inputting process information. An electronic control device forms a modular building block and is attached to the base frame and electrically connected to the print apparatus. A power supply forms a modular building block and is attached to the base frame and electrically connected to the electronic control device. The modular building blocks can be easily mounted and easily demounted based on engageable and disengageable attachment means disposed at the base frame Attachment means are provided for mounting and demounting of a function module selected out of at least two functionally non-equivalent function modules. In this case, at least two functionally non-equivalent function modules are each interface-compatible relative to said attachment means.

A front cover cap mountable to and demountable from the base frame can cover the print apparatus and can surround the keyboard. A demountable rear cover cap can cover the power supply and a selectable function module.

A rear cover cap can be provided for covering the print-apparatus modular building block, for protecting the power-supply modular building block and the journal-printer modular building block A front cover connectingly join at the rear cover cap.

An interface adapter slot can be provided at the rear side of the base frame.

Preferably, the selectable function module is an optical character-recognition device disposed on the base frame between the print apparatus and the power supply. A casing floor trough can be disposed at the base frame. A selectable function module can be disposed in the casing-floor trough.

Preferably, the print substrate transport device can include several pairs of friction-drive rollers provided at the base frame and a step-drive motor with drive engaging at least one roller axis and disposed below the base frame and provided for the advance of the print substrate material.

A selectable function module can be formed by a journal-printer attached to the base frame and disposed opposite to the power supply.

The print apparatus can be provided with a print head having at least 18 pins. The base frame can be provided with sides. The print apparatus is preferably provided at the distance of the sides of the base frame. Side walls can be provided in the distance of the sides of the base frame. These side walls can be connected to each other with slide guide rods. Preferably, the print apparatus is provided with a drive block comprising an electric drive motor, a drive gear, and a cycle clock station for sending signals for the print head control, a print head movable back and forth on slide guide rods with an automatic paper-thickness compensation device and a color-tape cassette insertable between the side walls, which units altogether form the print-apparatus modular building block.

The selectable function module can be an optical character-recognition device provided with a guide frame comprising two parallel guide rods. These guide rods can be attached in a side plate of the guide frame. A second selectable function module can be a reading device, functioning as a read head or as an optical line searcher, and can be provided with a drive The reading device can be disposed in a receiver casing and these units altogether can form function modules.

Preferably, the selectable function module is a journal printer provided with a print counter support attached in a printer frame with one or two parallel journal paths, with a cutting device, a multicolor inking ribbon cassette, a color-tape drive, an optical marking searcher, a print head, with a print-head drive.

The attachment means for mounting and demounting of two alternative members can be provided by two sockets with a plurality of electrical contacts, each disposed on a board, with an opening in the board disposed between the sockets. The modular building blocks can each include two plug sections matching the respective sockets. A function element of the modular building block can be disposed between the two plug sections.

According to the invention, there is provided a base model which comprises a printer apparatus, a printing-object transporting device, an operating field, an electronic control device, and a power supply, where the printer apparatus, the power module, and the electronic control device form in each case module devices, which can be easily mounted at a receiving and bolting means disposed on a base frame and which, at the same time, can be easily detached. Further receiving and bolting means can be provided at the base frame for an optical character-recognition device and/or for a magnetic-strip processing and/or for an optical line searching and/or for an optical searching of markings and/or for a journal-printer modular building block. The invention therefore allows to start with a base model, with which forms, records, checks, savings booklets, driver licenses, passports, identification cards, motor vehicle documents, picture-text BTX texts, and teletext texts can be printed on or printed, where the printer requires a minimum expenditure depending on the specific situation employed or reassigned to the printer. The only additional requirement, which is however of substantial importance in production technology or for economic considerations, are the various options for additional functions However, such a requirement is of minor importance from an economical point of view because, in case of a change of the production to additional functions, no changes are required in the principle and main production process.

It is furthermore advantageous in this context if the base model is provided with a cover cap in the front, which covers the printer apparatus and the operating field and if a rear cover cap is provided which can be removed and which covers the power supply and the further modular building blocks. Therefore, the invention system is in particular easy to maintain because the modular groups are easily accessible after removal of the individual cover caps and allow an accessibility of 100% for practical purposes. Therefore, the invention does not make use of hinged structural components such as this technology is employed in television apparatus and in the cited state of the art.

An enlargement of the printer with respect to the number of functions equals, in some cases, an enlargement of the printer in its dimensions. For this purpose it is provided that an extended rear cover cap can be provided for the covering of the printer-apparatus modular building blocks, for the power-supply modular component, and for the journal-printer modular component, which protects and which joins the front cover cap.

A further increase of the accessibility of the individual component groups is provided by furnishing an interface adapter slot at the rear side of the base frame.

The capabilities of the printer for certain functions or processing steps is further increased in that the base model is expanded by an optical character-recognition device between the printer apparatus and the power supply and by expanding with a recognition electronic disposed in the casing-floor trough and/or by a magneticstrip processing and/or by an optical line searching. The printer receives thereby the multifunctional property to be able to optically read certain types of printing. At the same time, savings booklets with magnetic strips can be processed. In this case, there is also provided an optical line searching. Furthermore, a corresponding marking in a defined column on the journal (record roll) can be recognized for correct printing and cutting of preprinted forms from the roll.

According to further features of the invention, several pairs of friction-drive rollers and a step motor, disposed under the base frame and engaging at least at one roller axis together with a drive, are provided for the advancing of the objects to be printed on. Therefore, in this case, the paper-advance aggregate is accessible after removal of the individual modular building blocks but, however, cannot be swung open as a modular removable base aggregate itself in the form of an individual-form transport or, respectively, in the shape of an endless-form transport.

The expansion of the printer functions is further improved by expanding the base model with a journal-printer modular building block, which is disposed opposite to the power supply. These steps lead to expanding the base model in a certain direction, as will be illustrated further below.

A further aspect of the invention is concerned with the construction of the individual modular building blocks, which can be easily mounted and which can be easily demounted. In detail, this concerns the print apparatus, the optical character-recognition device and the journal printer.

The improving steps comprise individually that the print apparatus comprises an 18-pin or 24-pin print head and that side walls are provided about at a distance of the wide sides of the base frame. The side walls are connected to each other by means of slide guide rods such that the print apparatus comprises a drive block, including an electric drive motor, preferably a gear drive, and a cycle clock station providing signals for the print-head control, a print head, which can be moved back and forth on the slide guide rods, with an automatic paper-thickness balancing device and with a multicolor inking ribbon cassette, which can be inserted between the side walls, and which components together form the print-apparatus modular buildings blocks. This print-apparatus modular building block can be autonomously removed after removal of the front cover cap and after pulling the respective electric or, respectively, electronic plug connections completely out of the printer as is described further down.

A further improvement of the invention now comprises that the optical character-recognition device includes a guide frame, comprising two parallel guide rods, which are attached in side plates. Furthermore, a drive for the read head or for the optical line searching are provided and also disposed in a receiving casing. These units together form the the group of modular building blocks. In this case as well, the modular building block can be exchanged easily as a whole in case of necessary repairs.

In the context of the present invention, a selectable function module is a modular unit for direct interaction with a transported record such as an optical character-recognition device, a magnetic-strip processing unit, an optical line searching unit, an optical marking searcher, and a journal-printer modular building block.

In the context of this disclosure, a function module, selectable out of at least two functionally non-equivalent function modules, consists of a module, where there are two modules available, with each of the two modules selected from a different, separate member of the group consisting of an optical character-recognition device, a magnetic strip processing unit, an optical line searching unit, an optical marking searcher, a journal printer modular building block.

Compatibility of a function module, selectable out of at least two functionally non-equivalent function modules, means that this function module is compatible relative to the attachment means on the frame A function module, where the function module is selected from a group of function modules performing non-equivalent functions but substitutable against each other on the receiver and bolting means notwithstanding such non-equivalence of respective functioning, is defined as a function module where there exist two function modules with each of the two function modules selected from a different, separate member of the group consisting of an optical character-recognition device, a magnetic strip processing unit, an optical line searching unit, an optical marking searcher, a journal printer modular building block.

In the context of this disclosure, a function module, selectable out of at least three functionally non-equivalent function modules, consists of a module, where there are three modules available, with each of the three modules selected from a different, separate member of the group consisting of an optical character-recognition device, a magnetic strip processing unit, an optical line searching unit, an optical marking searcher, a journal printer modular building block.

Finally, a further improvement of the invention comprises that the journal printer includes a printer support or block attached to a printer frame, one or two parallel journal paths, a cutting device, a multicolor inking ribbon cassette, a ribbon drive, an optical searcher for markings, a print head with print-head drive, which altogether form the group of journal-printer modular building blocks. These steps are particularly advantageous in the planning of production for multi-functional printers with a high number of functions, where such a journal-printer modular building block can be easily added to the base model.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
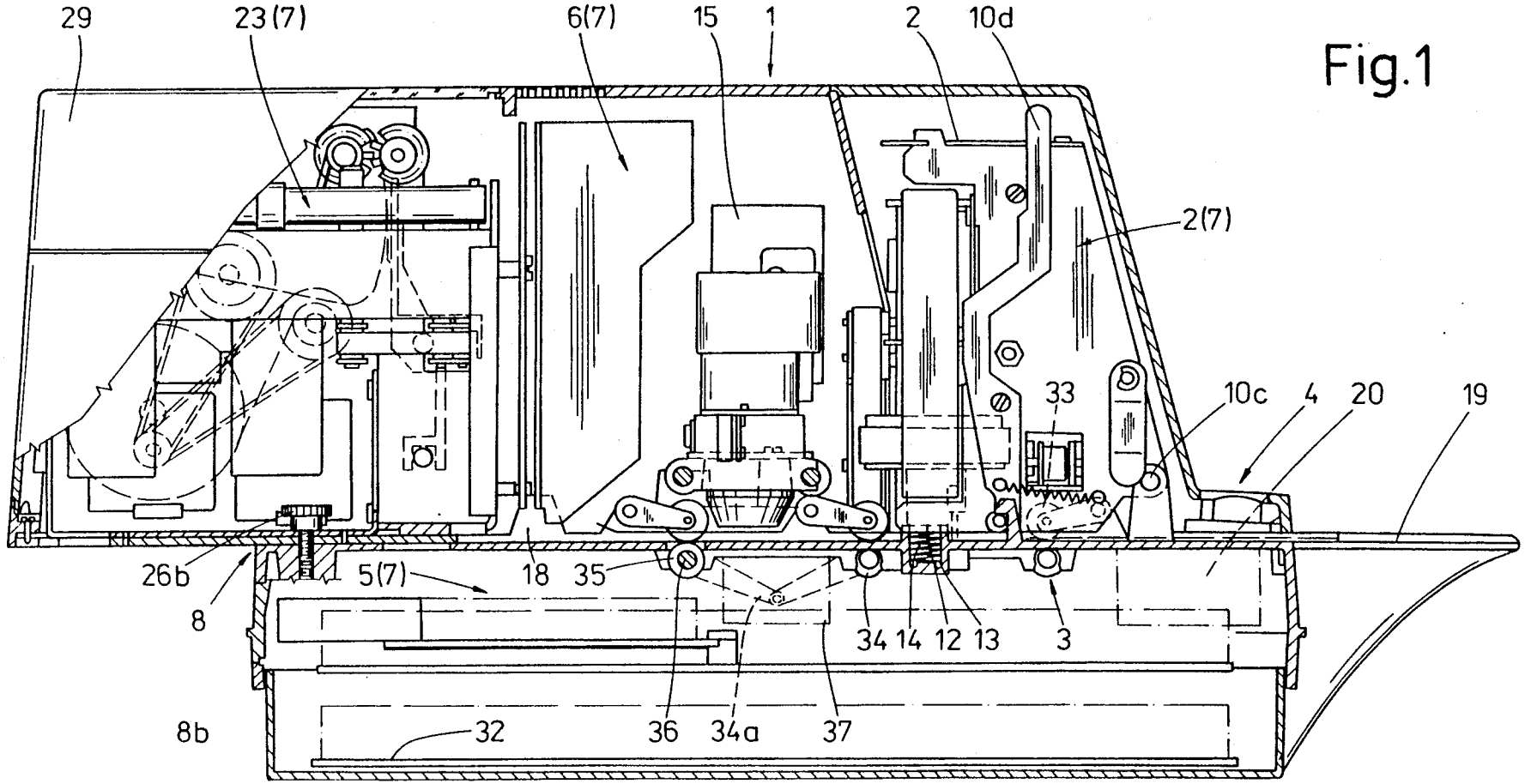
FIG. 1 is a vertical longitudinal sectional view through a printer which includes a maximum number of functions.
Figure 3:
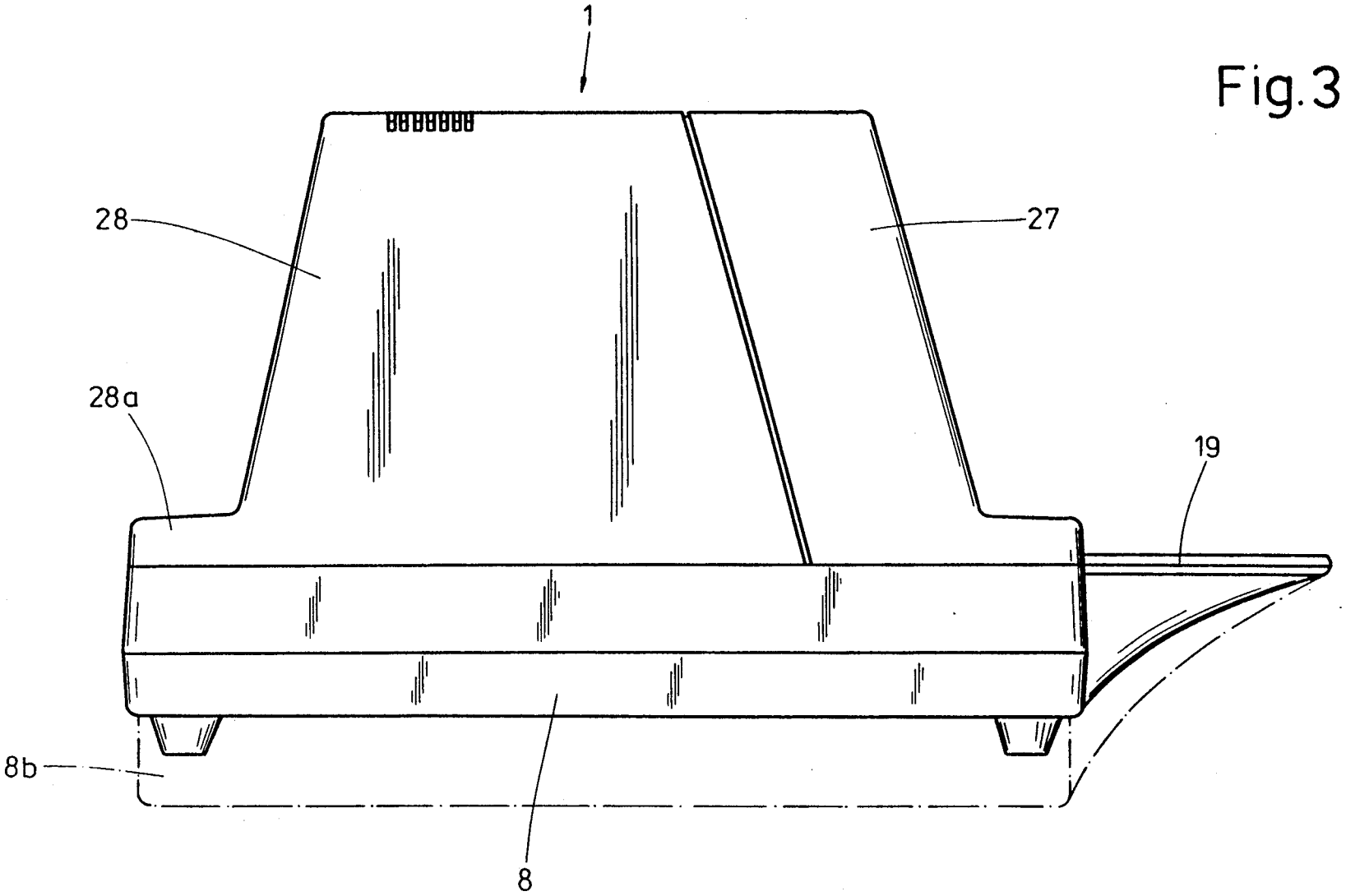
FIG. 3 is a side view of the base model with the cover caps in position.

According to FIGS. 1 and 3 of the invention, the printer for a plurality of different printing objects comprises a base model 1. The base model comprises a print apparatus 2, a print-object transport device 3, an operating field or keyboard 4, an electronic control device 5, and a power supply 6. The print apparatus 2, the power supply 6, and the electronic control device 5, in each case, form modular building blocks 7. The modular building blocks 7 can be easily mounted and easily demounted based on receiver and bolting means 9, 10 or, respectively, 9*a*, 10*a* disposed at a base frame 8, The base frame 8 is provided with additional receiver and bolting means 9, 10 or, respectively, 9*b*, 10*b* for a selectable function module. The function module is selected from a group of function modules performing different functions, but substitutable against each other on the receiver and bolting means notwithstanding such difference of respective functioning.

Preferably, the base model 1 comprises a demountable front cover cap 27 covering the print apparatus 2 and surrounding the operating field or keyboard 4 and a demountable rear cover cap 28 covering the power supply 6 and additional modular building blocks 7.

Preferably, a rear cover cap 29 is provided for covering the print-apparatus modular building block 2, 7, for protecting the power-supply modular building block 6, 7 and the journal-printer modular building block 23, 7. A front cover cap 27 can be provided at the rear cover cap.

Figure 4:
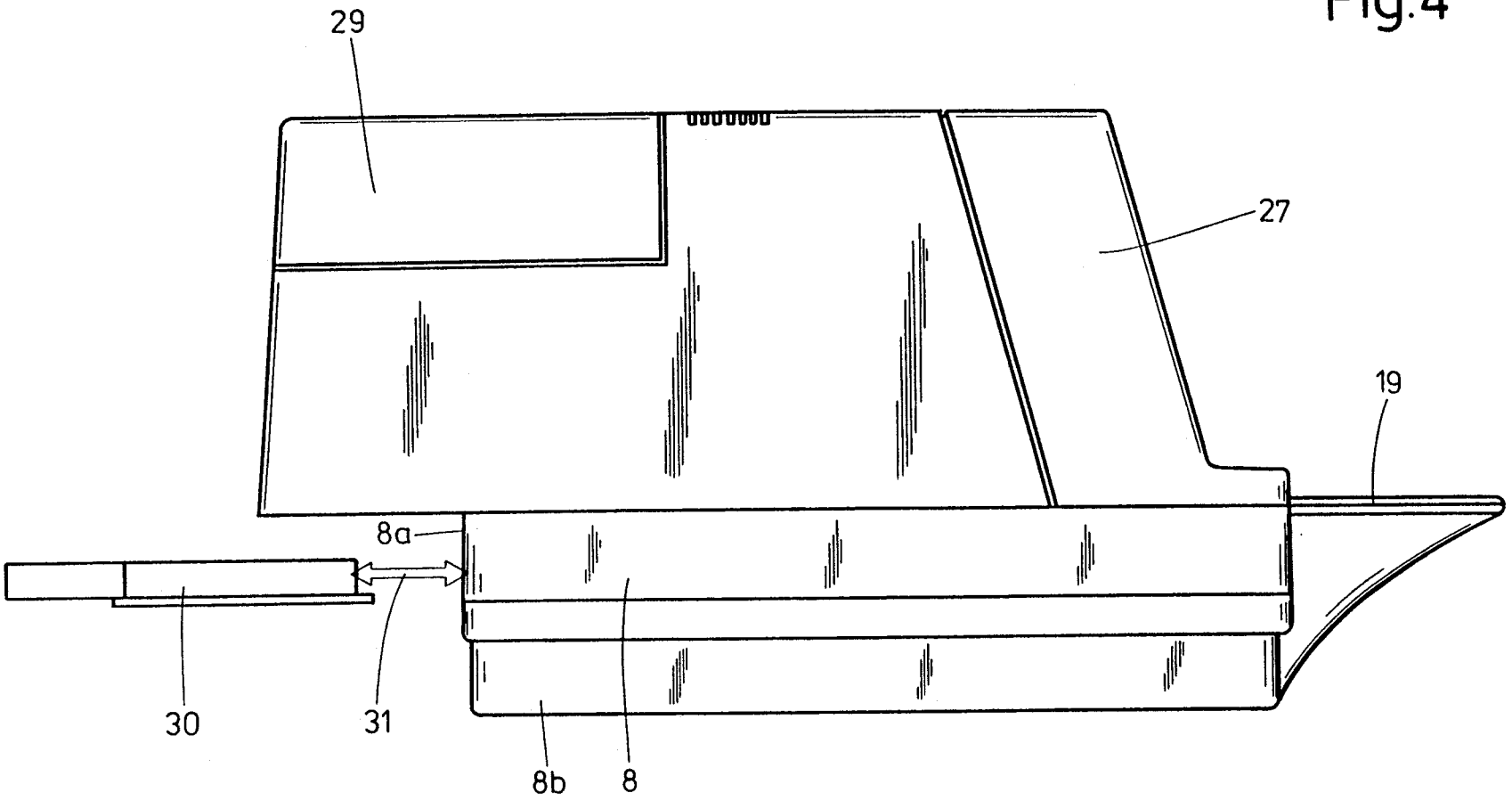
FIG. 4 is a side view of the printer according to FIG. 1 with the cover caps in position.

An interface adapter seat 30 can be provided at the rear side 8*a* of the base frame 8 as illustrated in FIG. 4.

The base model 1 can be expanded by an optical character-recognition device 15 disposed between the print apparatus 2 and the power supply 6 and expandable by a recognition electronic 32 disposed in a casing-floor trough 8*b* and by a selectable function module as illustrated in FIG. 1. The recognition electronic 32 furnishes an electric control device.

Several pairs of friction-drive rollers 33, 34, 35 can be are provided at the base frame 8. A step-drive motor 37 with drive engaging at least one roller axis 36 and disposed below the base frame 8 can be provided for the advance of the printing object.

Figure 5:
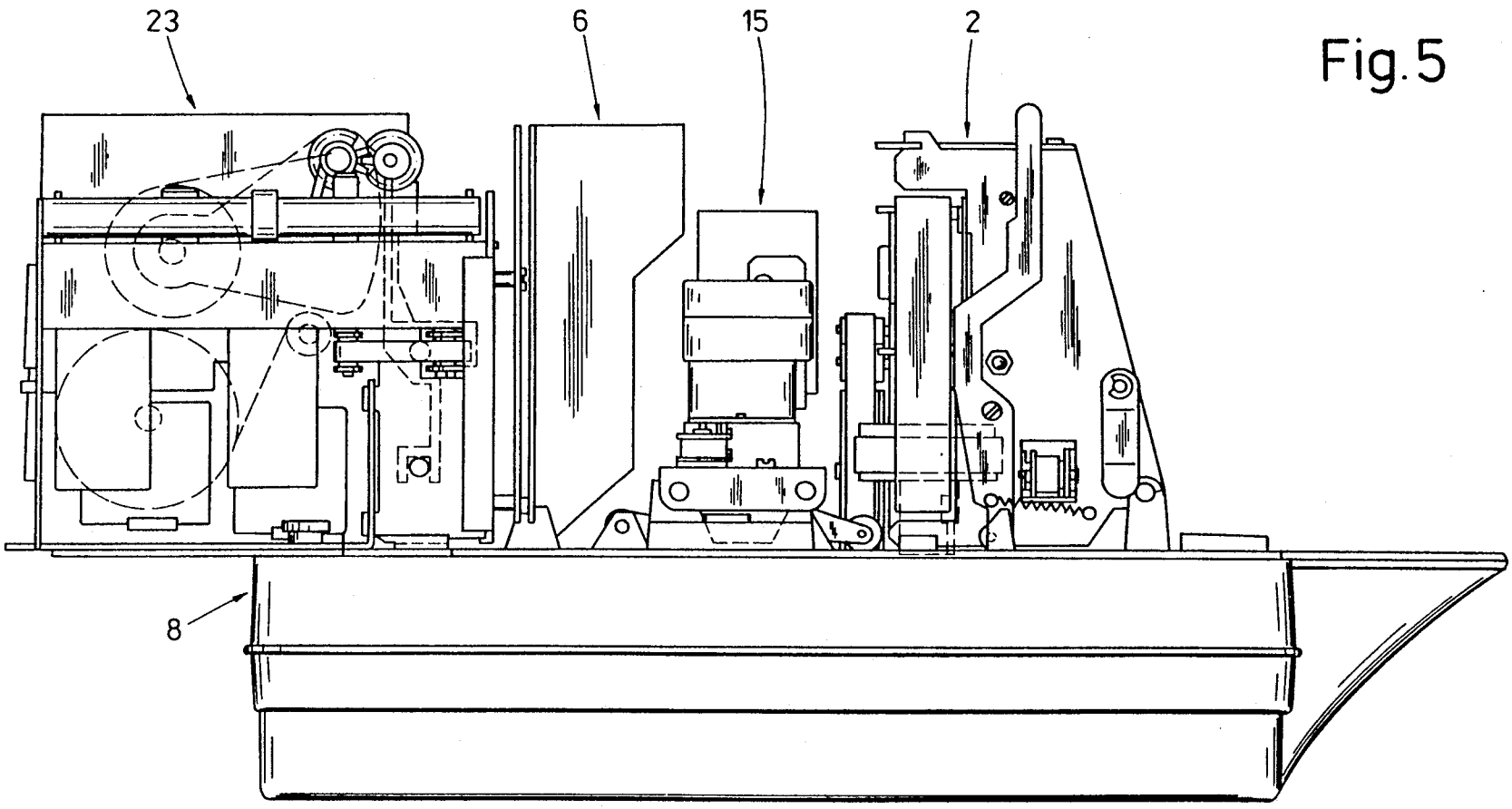
FIG. 5 is a side view of the printer according to FIGS. 1 and 4 with cover caps removed.

The base model 1 can be expanded by a journal-printer selectable function module 23 disposed opposite to the power supply 6 as illustrated in FIG. 5.

Preferably, the print apparatus 2 can be provided with an 18-pin or 24-pin print head 40 and can be provided about at the distance of the sides 8*c* of the base frame 8. Side walls 41*a*, 41*b* can be provided about in the distance of the sides 8*c* of the base frame 8. These side walls 41*a*, 41*b* can be connected to each other with slide guide rods 42, The print apparatus 2 can be provided with a drive block 43 comprising an electric drive motor 44, a drive gear 45, and a cycle clock station 46 for sending signals for the print head control, a print head 40 movable back and forth on the slide guide rods 42 with an automatic paper-thickness compensating device 49 and a multicolor inking ribbon cassette 39 insertable between the side walls 41*a*, 41*b*, which altogether can form the print-apparatus modular building block 7.

Figure 8A:
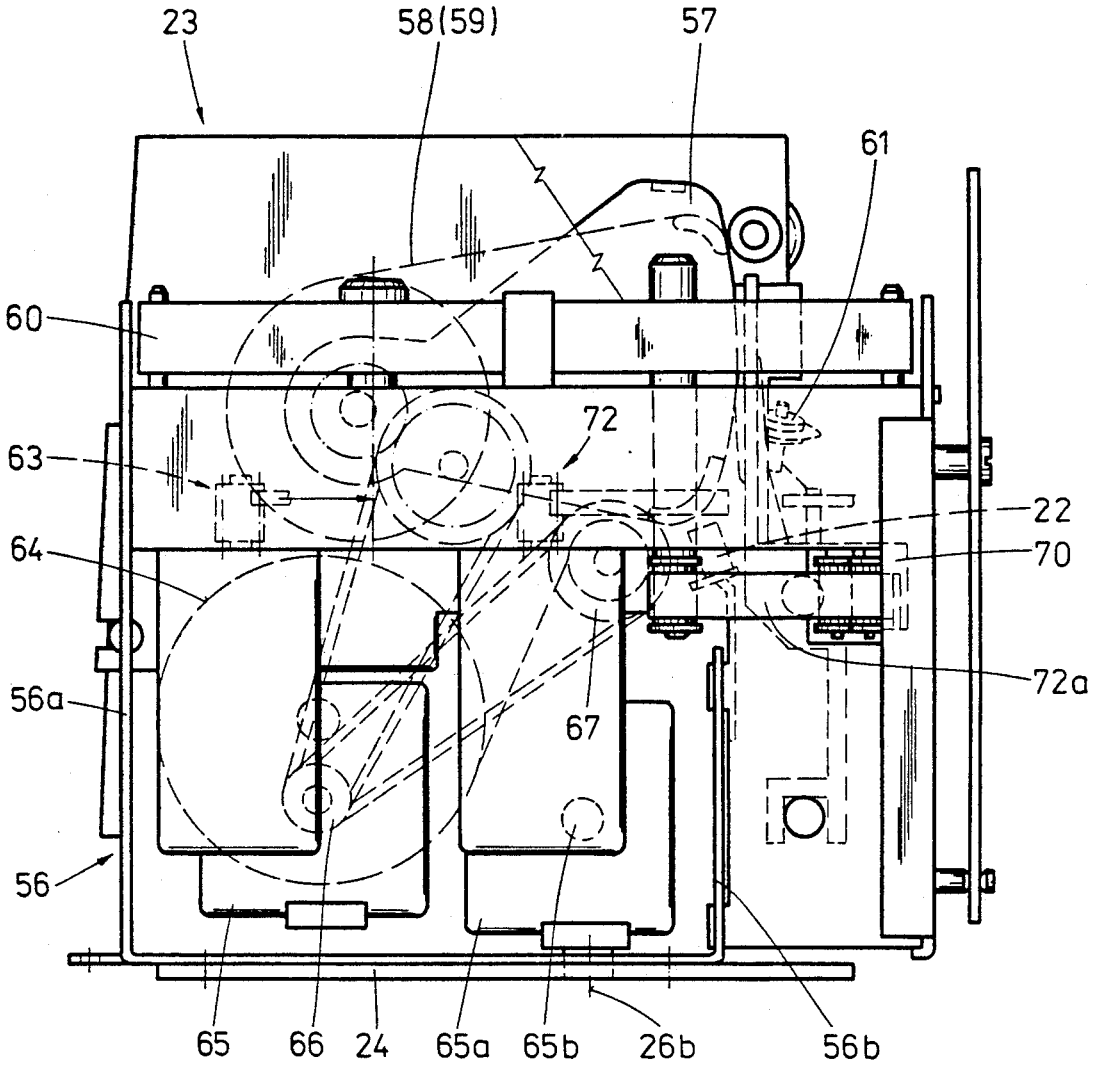
FIG. 8A is a side view of the journal-printer modular building block.
Figure 8B:
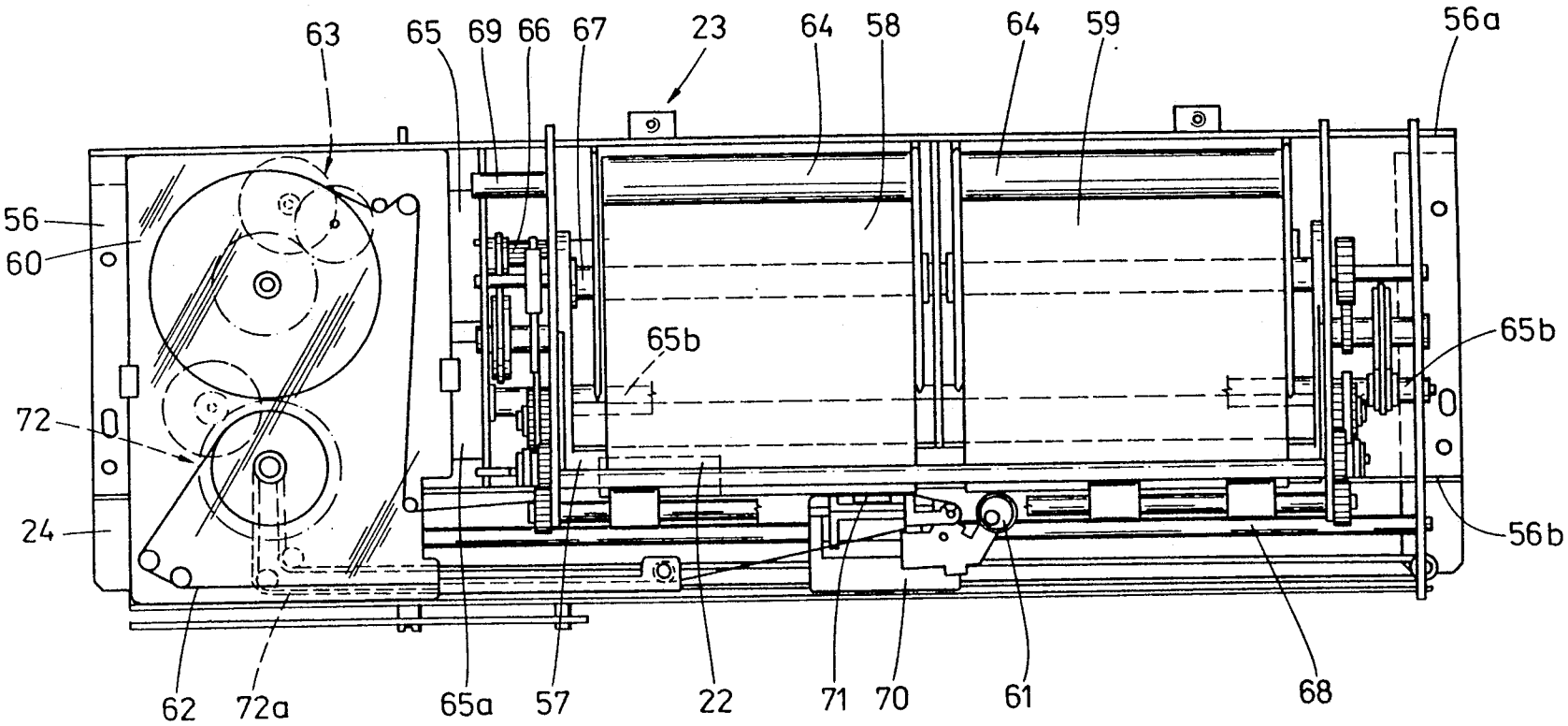
FIG. 8B is a top view onto the modular building block "journal printer".

Preferably, the selectable function module can be an optical character-recognition device 15 provided with a guide frame 50 comprising two parallel guide rods 51*a*, 51*b*, which can be attached in side plate 52*a*, 52*b*, and can further include a drive 53 for the read head 54 or for an optical line searcher 21, which can be disposed in a receiver casing 55 and which altogether can form the modular building block 7 as illustrated in FIGS. 8A and 8B.

A second selectable function module can be furnished as a journal printer 23 can be provided with a print counter support 57 attached to a printer frame 56, with one or two parallel journal paths 58, 59, with a cutting device 61, a multicolor inking ribbon cassette 60, a multicolor inking ribbon drive 63, an optical marking searcher 22, a journal print head 71 with a print-head drive 72, and which altogether can form the second selectable function module.

According to FIGS. 1 and 3, the printer is provided as base model 1 with the described expansions and forms therefore the desired multi-form printer, i.e. a printer with a high number of functions, which can be employed in an application case in part or complete. A print apparatus 2, a print-object transporting device 3, an operating or keyboard field 4, an electronic control device 5, and a power supply 6 form the substantial components of the base model 1. The print apparatus 2, the power supply 6, and the electronic control device 5 form here, in each case, a compact, autonomous, demountable modular building block 7. Each of the modular building blocks 7 includes its own support at the base frame 8 of the printer. The base frame 8 exhibits for each modular building block 7, in each case, receiving means 9 and bolting means 10, where the receiving means 9 can, under certain conditions, form at the same time the bolting means 10.

Figure 2:
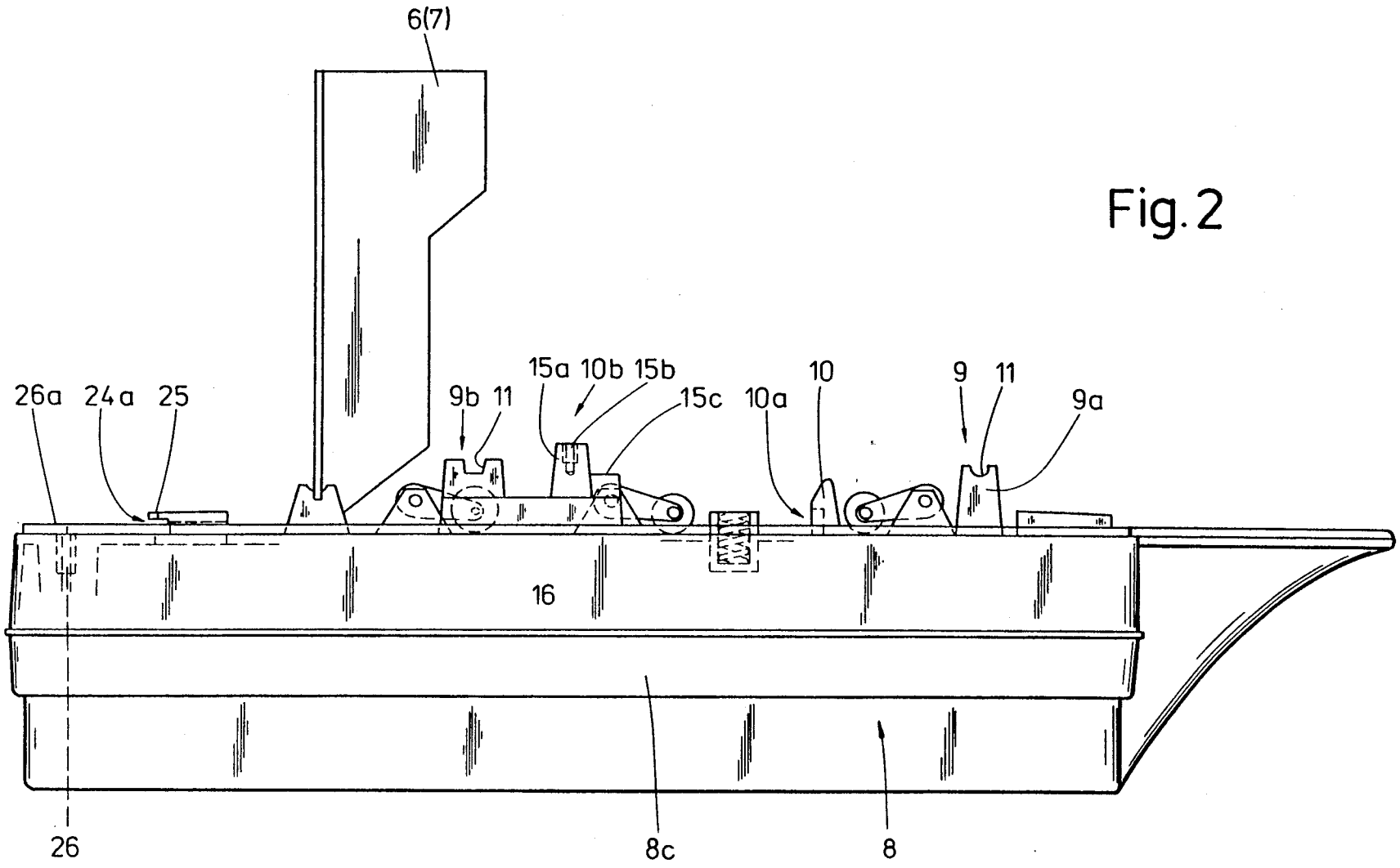
FIG. 2 is a view of the printer according to FIG. 1 in a side view after removal of all cover caps and of the modular building blocks, with the exception of the power-supply modular building block.

The receiving means 9 and the bolting means 10 are illustrated in detail in FIG. 2 and are emphasized there. In the context of the printing apparatus 2, for example, the bearing blocks 9*a* form the receiver means 9 for a rod 10*c* of the printer apparatus 2 and a lever receiver 10*a* forms the bolting means 10.

The printer apparatus 2 is in addition supported via a lever extension 12 on a spacer body 14 provided with a compression spring 13.

Figure 7:
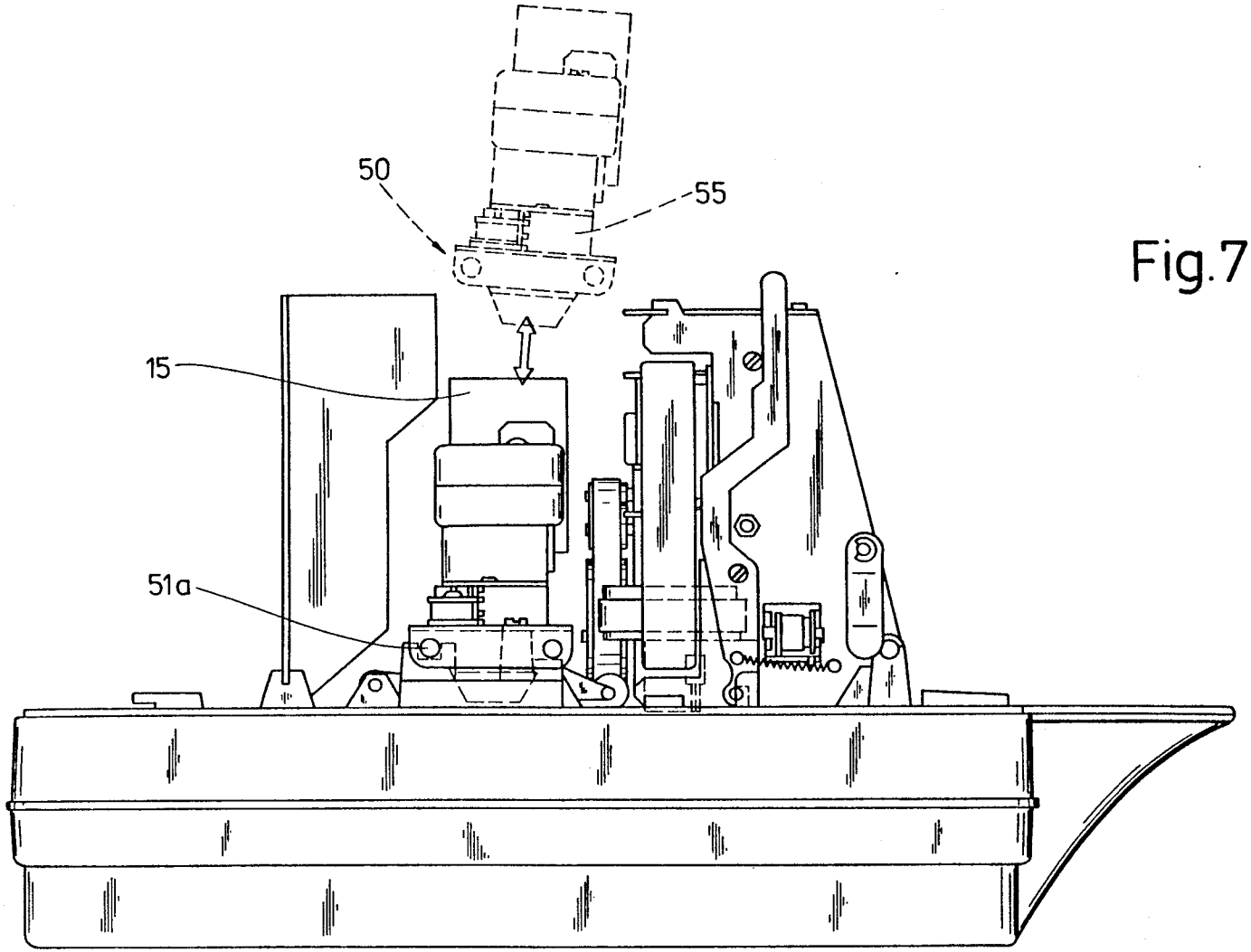
FIG. 7 is a side view of the multifunctional printer according to FIGS. 1, 4, 5, and 6 at the point of the removal or, respectively, the mounting of the character-recognition device.
Figure 7A:
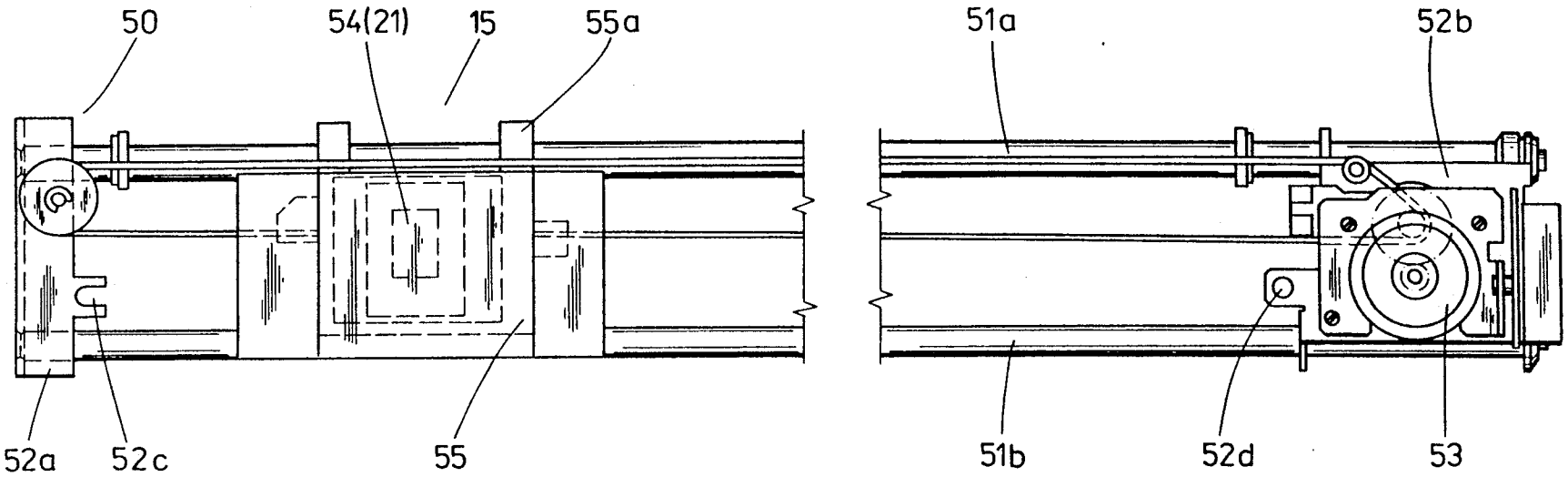
FIG. 7A is a top view onto the modular building block "optical character recognition"

A similar support is provided for the optical character-recognition device 15, compare FIGS. 1, 7, and 7A. Receiver means 9*b* and bolting means 10*b* are disposed in pairs on a platform 16 at a distance to each other. The bolting means 10*b* in addition includes a recess 11, into which also a rod 51*a*, belonging to the modular building block 7 "optical character recognition 15", can be hanged.

Side plates 52*a*, 52*b* of the character-recognition device 15 are attached on a first shoulder 15*a* with a thread 15*b*. A part of a guide frame 50 is supported by a second shoulder 15*c*.

Another modular building block 7, comprising the power supply 6, is clamped into a pair of similar support protrusion 18. A magnetic-strip processing device 20 is attached below the document input and mounting plane 19 and within the base frame 8. The described receiving means 9 or, respectively, 9*b* and the bolting means 10 or, respectively, 10*b* can be disposed for a certain purpose also within one modular building block 7. Thus, the optical marking searcher 22 is disposed within the journal-printer modular building block 23 (FIG. 8A).

The modular building block 7 of the journal printer 23 is connected via a support plate 24 and a slot 24*a* by means of an attachment means 25 to the base frame 8, where the journal printer 23 is connected with the support plate 24. In this case, the support plate 24 rests from below against the attachment means 25. The support plate 24 is in addition attached with a thread 26 on a surface 26*a*.

A detachable cover cap 27 surrounds the printer, in the case of the base model 1 as shown in FIG. 3, where the cover cap 27 covers the print apparatus 2 and surrounds the operating field 4. The power supply 6 and possibly further modular building blocks 7 are protected by a detachable rear cover cap 28, which cover cap 28 forms a step 28*a*.

In case of an expanded base model 1, as illustrated in FIG. 4, the print apparatus 2 is protected with the front cover cap 27. In contrast, the modular building block 7 of the power supply 6 and the modular building block 7 of the journal printer 23 are surrounded by an extended rear cover cap 29 following immediately the front cover cap 27. A form opening for an interface adapter seat insertion 30 is provided below the extended rear cover cap 29 at the rear side 8*a* of the base frame 8. The interface adapter seat insertion 30 can be mounted or, respectively, demounted by sliding in the arrow direction 31.

The expanded base model 1 according to FIGS. 1, 4, and 5 exhibits in addition the optical character-recognition device 15, which is disposed between the print apparatus 2 and the power supply 6. In addition, there is provided a respective recognition electronic 32, provided as a printed circuit board, which is not present in the base model 1 and which is disposed in the casing-floor trough 8*b* (FIG. 1). The base model 1 therefore does not require in addition the particular casing-floor trough 8*b*. The magnetic-strip processing 20 is also to be considered as an expansion, as well as the optical line searcher 21 (FIG. 7A), and the optical marking searcher 22 (FIG. 8A), which are employed in the modular building block 7 of the journal printer 23.

In contrast, the base model 1 comprises on the base frame 8 several pairs of friction drive rollers 33, which are distributed over the width of the printer, where the first row of these rollers is disposed in the imprint receiving substrate input area of the document input and mounting plane 19. In addition, further pairs of friction drive rollers 34 are driven via pulling means 34*a* through a step-drive motor 37 in advance direction behind the print apparatus 2. Additional pairs of friction drive rollers 35 are supported at the base frame 8 in the advance direction behind the character-recognition device 15.

Advantageously, in each case a roller axis 36, and in fact the roller axis disposed at the bottom in each case, is driven in the case of the friction roller pairs 33, 34, and 35. A step-drive motor 37, not illustrated in detail, together with a drive, is present below the base frame 8. The step-drive motor 37 transfers a rotary torque to individual or all roller axes 36 via pulling means 34*a*.

The base model 1 can be expanded by a modular building block 7 of a journal printer 23, and in fact in the way that, in case a printer apparatus 2 and a power supply 6 are present, then the journal printer 23 is disposed opposite to the power supply 6, whereby the printer is expanded overall and whereby the extended rear cover cap 29 is being used (FIG. 5).

Figure 6:
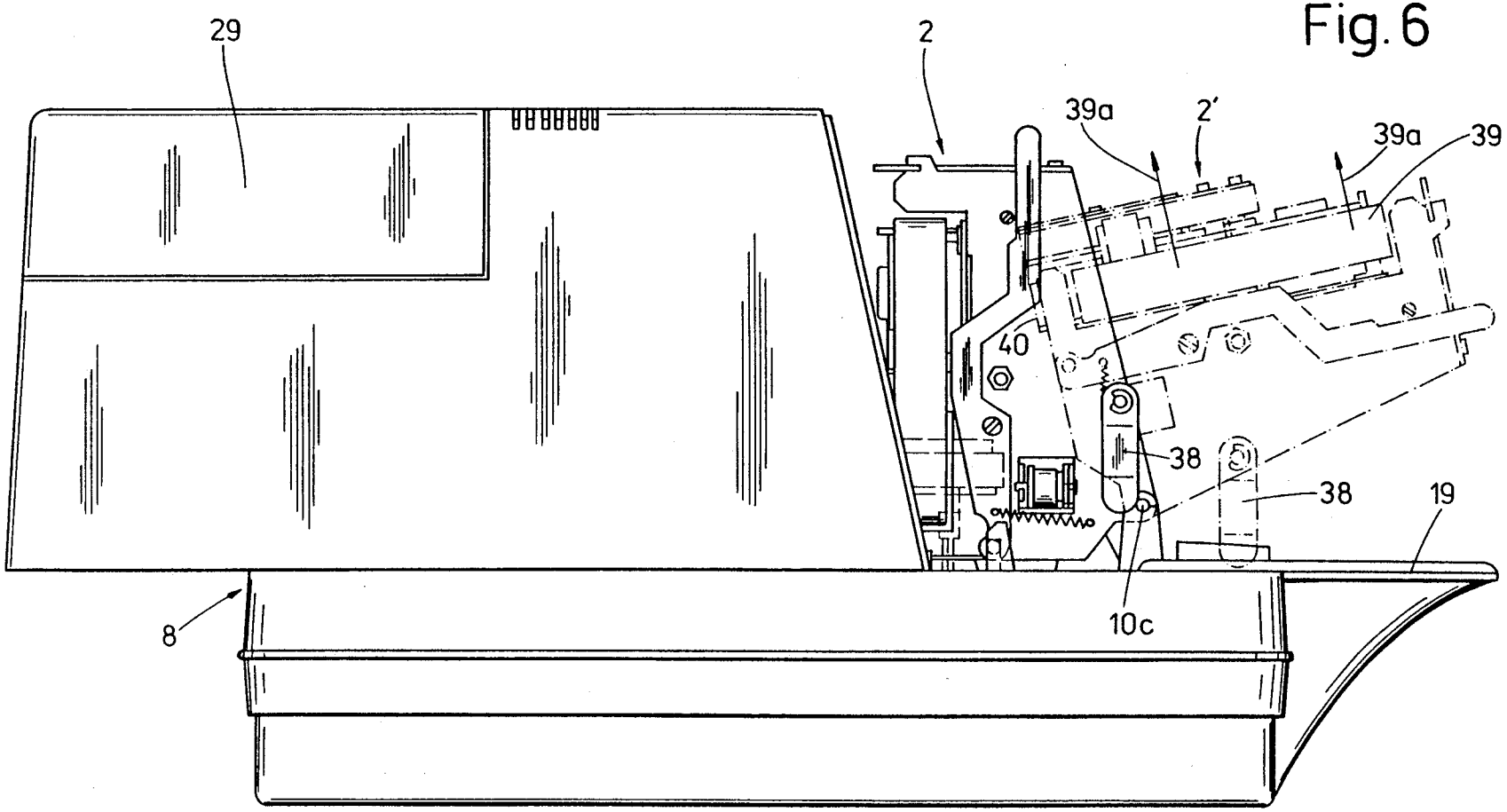
FIG. 6 is a side view of the printer according to FIGS. 1, 4, and 5 the front cover cap removed.

In the following, further important modular building blocks 7 are described in order to show that an easy and quick demounting can be provided by the system of the modular building blocks 7. The print apparatus 2 is easily accessible both at the base model 1 as well as in the case of the extended model by removal of the cover cap 27 (compare FIG. 3). Possibly required service work can be performed at the print apparatus 2 by tilting the print apparatus 2 around the axis of a rod 10*c* into the position 2' and by supporting the print apparatus with a support linkage 38 on the mounting plane 19, whereby the print apparatus is disposed substantially horizontal. For example, the multicolor inking ribbon cassette 39 can be easily exchanged in arrow direction 39*a* in this horizontal position of FIG. 6 of the print apparatus. Similarly, the print head 40, which comprises for example an 18-pin or 24-pin print head, can be easily exchanged. The print apparatus 2 can be lifted quickly and easily out of the recess 11, open from above, in case of a further demand in service work, as illustrated in FIG. 2.

This mode of handling can be accomplished for all modular building blocks 7 based on the compact construction, where advantageously all building parts are disposed within a base frame 8, as shown in FIG. 5.

Figure 6A:
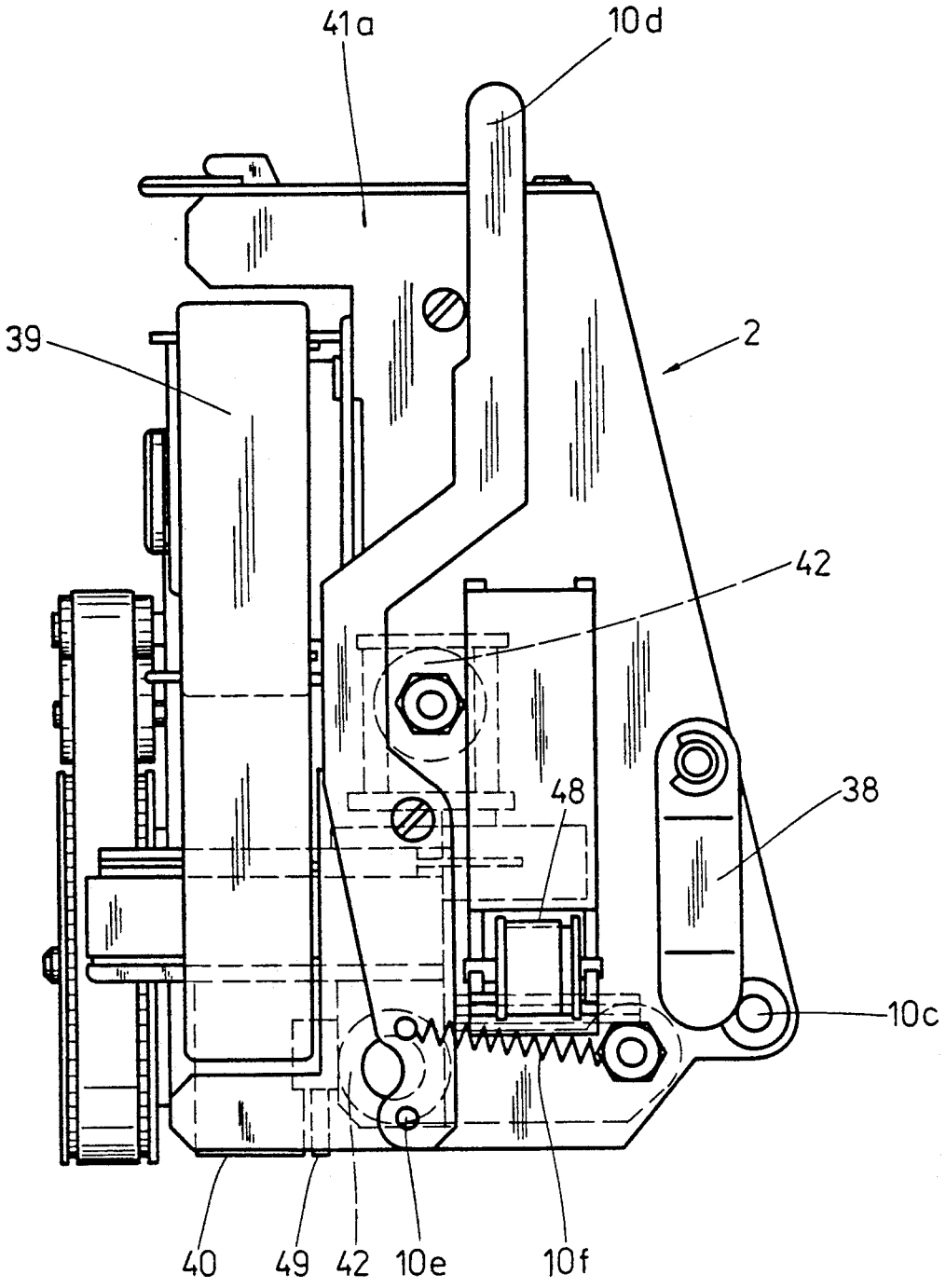
FIG. 6A is a view of the demounted print-apparatus modular building block.
Figure 6B:
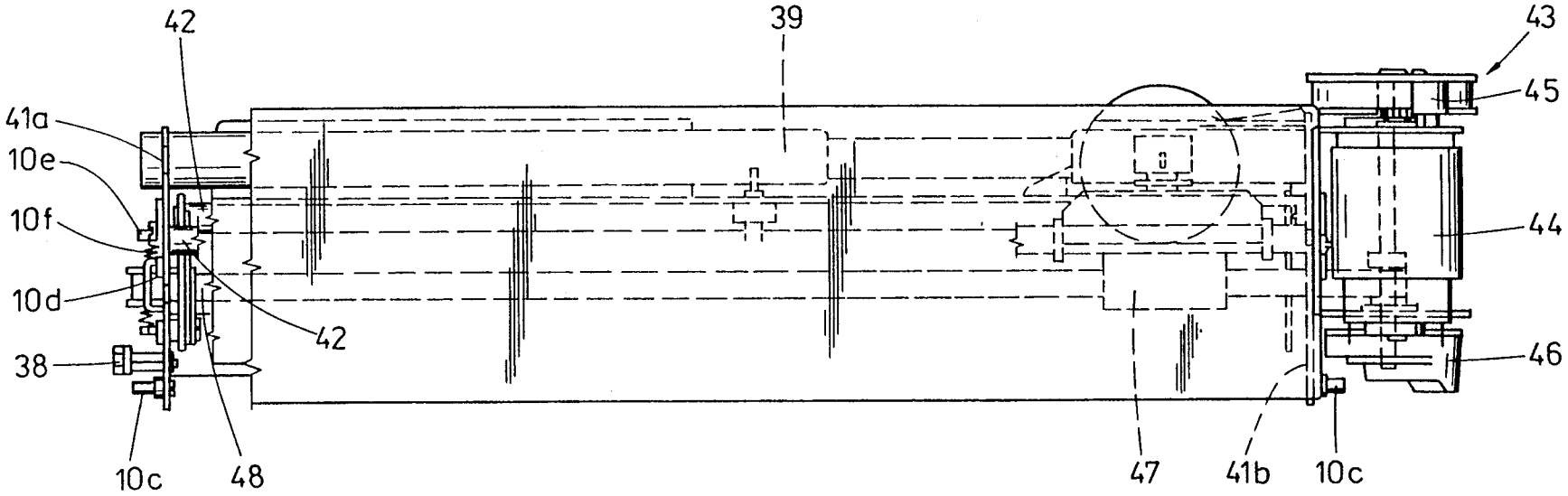
FIG. 6B is a top planar view of the print-apparatus modular building block.

The print apparatus 2, as illustrated in FIGS. 6A and 6B, is adapted to the width of the printer, i.e. side walls 41*a* and 41*b* with sliding guide rods 42 are connected to a frame about at a distance of the wide sides 8*c* of the base frame 8, where the frame carries all device parts. The print apparatus 2 is supported by way of levers 10*d*, bolts 10*e*, springs 10*f* coordinated to the side walls 41*a* and 41*b* in the lever reception 10*a* as a bolting means 10. A drive block 43 is formed at the end of this frame, which comprises an electric drive motor 44 and a gear drive 45. A so-called cycle tact station 46 is provided at the shaft end of the drive motor 44. Sender signals for the print-head control are transmitted from the cycle clock station 46, which signals control the slide 47 carrying the print head 40 independent from the path, i.e. the drive motor 44 drives the slide 47 via gear belt 48 in such a way that the letter characters and signs are transferred exactly onto the respective carrier for the print, for example the records. In addition, an automatic paper-thickness balancing device 49 is attached at the print head 40. The color-tape cassette 39 is inserted between the side walls 41*a* and 41*b*. All these device components as well as the device parts still present, however not mentioned, form the modular building block 7 of the print apparatus 2. The electric connection for the electromagnetic coils of the print head 40 are provided as usual and are therefore not illustrated.

The modular building block 7 of the optical character-recognition device 15 is constructed in a similar compact fashion as that of the print apparatus 2. Thus, the optical character-recognition device 15, shown in FIGS. 7 and 7A, forms a guide frame 50, which comprises two parallel guide rods 51*a* and 51*b* and side plates 52*a* and 52*b*. A drive 53 moves the read head 54 together with a receiving casing 55 and a slide 55*a* on the guide rods 51*a* and 51*b*. The electric connections for the drive 53 as well as for the read head 54 are formed as usual and are not illustrated in detail.

Instead of the elements of the read head 54, an optical line searcher 21 can be provided inside of the receiver casing 55. In addition, ears 52*c* or, respectively, openings 52*d* are provided at the side plates 52*a* and 52*b* for bolting at the base frame 8 of the modular building blocks 7 in the thread 15*b*.

The modular building blocks 7 of the journal printer 23, as shown in FIG. 8A, in addition to the support plate 24 exhibits a printer frame 56, which is formed from one or several support walls 56*a* and 56*b*. A printing counter support 57 is attached at the printer frame 56. The printer frame 56 in addition receives one or two parallel journal paths 58 and 59, compare FIG. 8B. In principle, two different transfer systems for generation of the printing on the support can be employed. A thermo-transfer system or thermo-direct printing is possible. Instead of the thermo paper, there can be employed a thermo tape for single use or for multi-use.

As illustrated in FIGS. 8A and 8B, a thermo-tape cassette 60 and a cutting device 61 are coordinated to the print counter support. The multicolor inking ribbon 62 is driven by a separate ribbon drive 63. A first drive motor 65 is provided for the drive of the paper-storage roller 64. The motor shaft 66 of the drive motor 65 drives on a transport shaft 67, which transport shaft 67 in turn moves the journal path 58. A second drive motor 65*a* drives with its motor shaft 65*b* the journal path 59. Connection rods 68 and 69 are attached in the printer frame 56, where a print-head slide 70 slides with a print head 71, or a thermo-print head. The print-head slide 70 is moved back and forth through a print-head drive 72 via a belt 72*a* ahead of the printing counter support 57 and print head is operated in the way conventional print heads are operated. The complete modular building block 7 of the journal printer 23 is attached with the support plate 24 on the surface 26*a* by way of threads 26 and a screw 26*b*, as illustrated in FIG. 1.

The printer apparatus can be provided for easy connection to the various modular building blocks. Most of these building blocks employ currents of various kinds to be powered up. In order to avoid clutter resulting from loose connection wires, it is possible to employ an electrical bus structure with plug receptacles or printed circuit board connector receptacles into which the various function modules are plugged. Elements of such bus structure can be mounted onto the base frame. The bus structure can be laid out to be suitable for substitution of certain modules, for example all modules involved in printing can be attached to a certain bus connection, all modules involved in power supply and control functions can employ a second bus connection, and all modules involved in reading, searching, and the like, can employ a third type of bus connections. It is possible that these bus connections are all different or that some or all of these bus connections are of the same type. The bus connections can be constructed such that no connectors are exposed if such connector does not have any module plugged in. The bus connectors can be disposed on the side of the path of the printing substrate material such as not to interfere with printing substrate material passing through the printer unit.

The attachment means can be of one or different types including bolting attachment, snap-in attachment, screw-on attachment, pin insertion, recess insertion, eyelet-hook connection, bolts, levers, springs. The attachment elements are positioned along the base frame at distances allowing sufficient space for placing the desired function modules on the base frame in a desired sequence.

These elements can be positioned along a line running in parallel to the advance path of the paper material for allowing a placement of a certain module at different desired locations along the base frame while still retaining a matched coordination with respect to the path of the advancing print substrate material. In particular, optical character recognition can be followed by a printing function operating depending on the results of the optical character-recognition input.

The base frame can be of modular construction such as to allow for expansion of the base frame in cases where more than a minimum or more than a standard number of functions are to be performed by the printer. Such expansion will comprise mechanical and electrical attachment and connection elements between a primary base frame and a base frame expansion part. Similarly, the covers can be provided including a main cover part and expansion cover parts corresponding to expansion-base frame parts.

A threaded gear shaft can be disposed in parallel to the advance direction of the print substrate material, but at a distance from the path of the print substrate material. The threaded gear shaft can be driven by an electric motor and connected to the electric motor by a transmission. Certain modules can engage this threaded gear shaft and this construction allows for a synchronization of mechanical functions of certain sequential function modules employed as well as for providing mechanical power to the modules. The threaded worm gear can further be coupled to the print substrate material advance mechanism.

Figure 9:
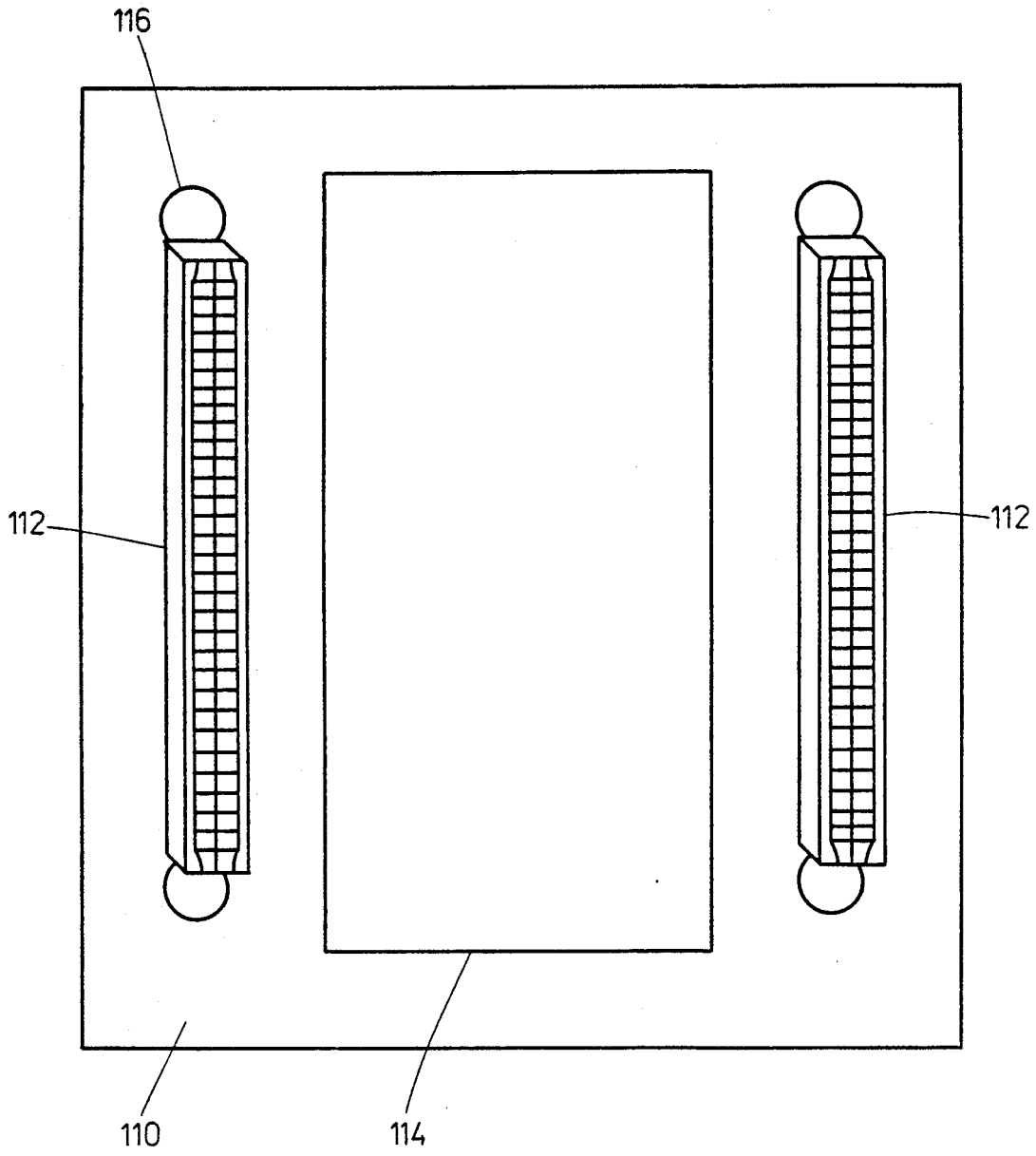
FIG. 9 is a schematic top plan view onto a mounting section for a module.
Figure 10:
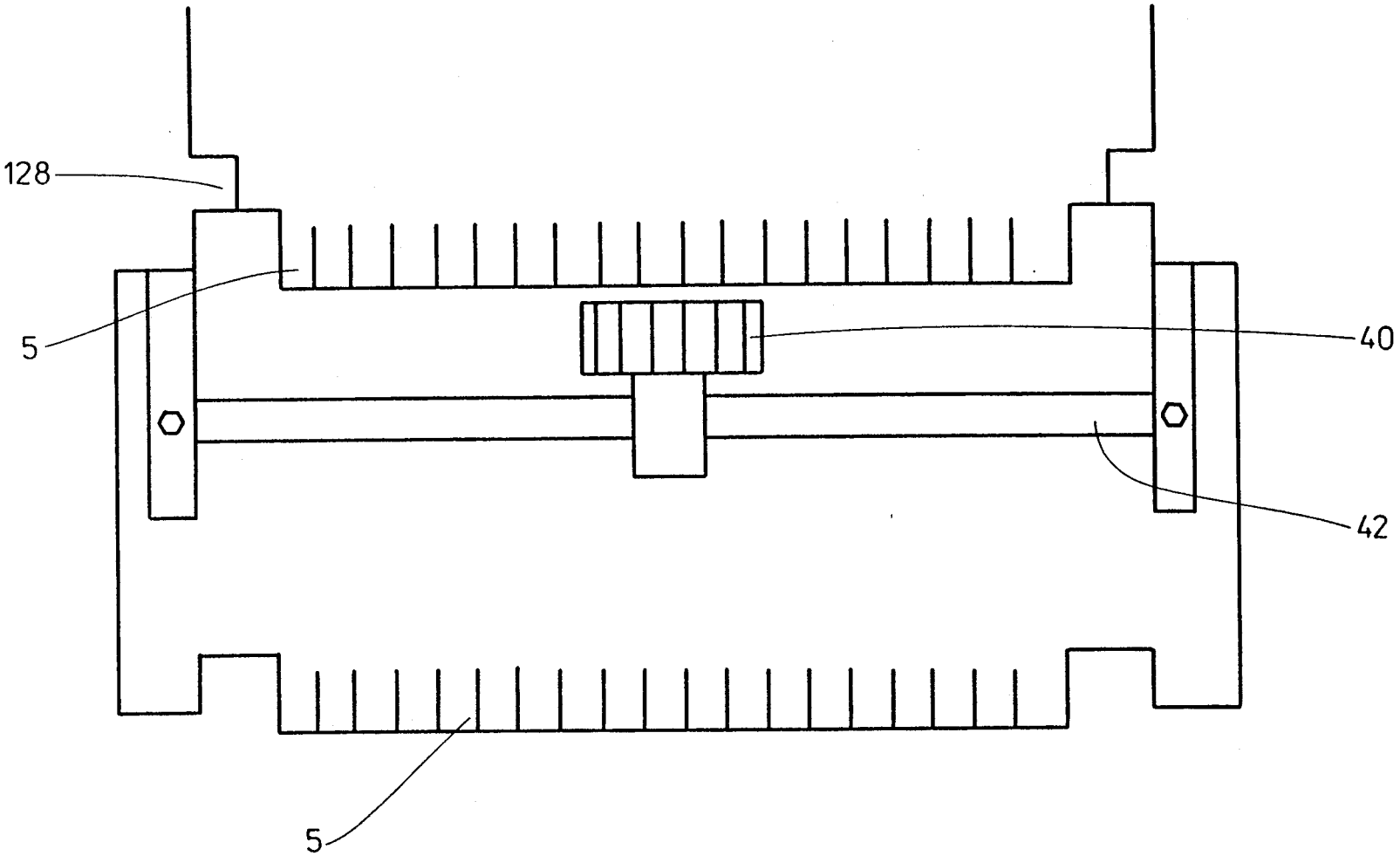
FIG. 10 is a schematic view of a print head module to be placed in the mounting section of FIG. 9.

FIG. 9 illustrates an example for a mounting section for different types of modules. A printed circuit board 110 of sufficient strength can form a base. Two parallel sockets 112 with an appropriate number of electrical contacts can be positioned on one and preferably two sides of an opening 114. The opening 114 is preferably longer than the length of the sockets 112. Alternatively, the sockets can be interrupted near the middle, and two socket sections can be disposed along one plane in sequence. Catch elements 116 can be provided at the ends of the sockets. FIG. 10 schematically illustrates a module which can be positioned in the sockets 112 of FIG. 9. Two printed circuit boards are formed which match the sockets 112 of FIG. 9. A print head 110 is disposed between the circuit boards or electronic control devices and is guided along slide guide rods 42. Recesses 128 are provided to match the catch elements 116 attached to the sockets 112. Differently functioning units can be constructed based on this principle, where the sockets provide an electrical connection for different types of modules.

The control system module can be constructed for automatic recognition of the presence of certain function modules and can incorporate a digital control system providing automatic adaptation to the function modules employed in a specific case. The control system can further incorporate safety features preventing user mismatch of function modules and test cycles for defective functioning of individual modules or of a lack of cooperation of certain function modules.

It will be understood that each of the elements described above, or two or more together, may also find a useful application in other types of printer systems differing from the types described above.

While the invention has been illustrated and described as embodied in the context of a printer system to process all internationally required forms, it is not intended to be limited to the details shown, since various modifications and structural changes may be made without departing in any way from the spirit of the present invention.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A printer for a plurality of different print substrate material processing functions comprising a base frame;

a print apparatus forming a modular building block and demountably attached to the base frame;

a print apparatus material transport device disposed on the base frame;

a keyboard attached to the base frame for inputting process information;

an electronic control device forming a modular building block and attached to the base frame and electrically connected to the print apparatus and to the keyboard;

a power supply forming a modular building block and attached to the base frame and electrically connected to the electronic control device;

attachment means for modular building blocks disposed at the base frame, wherein the modular building blocks can be mounted to and demounted from the attachment means for modular building blocks;

attachment means for mounting and demounting of a function module selectable out of at least two functionally differing function modules wherein at least two functionally differing function modules are each interface-compatible relative to said attachment means for mounting and demounting;

two function modules capable of performing at least two differing functions with each of the two function modules adapted for attachment to the attachment means;

wherein the print apparatus is provide with a print head;

the base frame is provided with sides;

the print apparatus is provided at the distance of the sides of the base frame;

side walls are provided in the distance of the sides of the base frame, which side walls are connected to each other with slide guide rods;

the print apparatus is provided with a drive block comprising an electric drive motor, a drive gear, and a cycle clock station for sending signals for a print head control, said print head being movable back and forth on said slide guide rods with an automatic print substrate material thickness compensating device and a color-tape cassette insertable between the side walls, thereby altogether forming the print apparatus modular building block.

2. The printer according to claim 1, further comprising a front cover cap mountable to and demountable from the base frame and covering the print apparatus and surrounding the keyboard; and a rear cover cap, mountable to and demountable from the base frame; covering the power supply and a selectable function module.

3. The printer according to claim 1, further comprising a rear cover cap provided for covering the print apparatus modular building block, for protecting the power supply modular building block and a modular building block furnishing a journal printer; and a front cover cap for connectingly joining at the rear cover cap.

4. The printer according to claim 1, wherein the base frame has a rear side and further comprising an interface adapter slot provided at the rear side of the base frame.

5. The printer according to claim 1, wherein the selectable function module is an optical character-recognition device disposed on the base frame between the print apparatus and the power supply; further comprising a casing trough disposed at the base frame, wherein said selectable function module is disposed in the casing-floor trough.

6. A printer for a plurality of different print substrate material processing functions comprising a base frame;

a print apparatus forming a modular building block and demountably attached to the base frame;

a print substrate material transport device disposed on the base frame;

a keyboard attached to the base frame for inputting process information;

an electronic control device forming a modular building block and attached to the base frame and electrically connected to the print apparatus and to the keyboard;

a power supply forming a modular building block and attached to the base frame and electrically connected to the electronic control device;

attachment means for modular building blocks disposed at the base frame, wherein the modular building blocks can be mounted to and demounted from the attachment means for modular building blocks;

attachment means for mounting and demounting of a function module selectable out of at least two functionally differing function modules wherein at least two functionally differing function modules are each interface-compatible relative to said attachment means for mounting and demounting;

two function modules capable of performing at least two differing functions with each of the two function modules adapted for attachment to the attachment means;

wherein the selectable function module is an optical character-recognition device provided with a guide frame comprising two parallel guide rods, which guide rods are attached in a side plate of the guide frame;

and further including a receiver casing;

a second selectable function module including a drive for a reading device functioning as a read head for character recognition on a print substrate, which reading device is disposed in the receiver casing and wherein the optical character recognition device and the receiver casing containing the reading device form function modules.

7. A printer for a plurality of different print substrate material processing functions comprising a base frame;

a print apparatus forming a modular building block and demountably attached to the base frame;

a print substrate material transport device disposed on the base frame;

a keyboard attached to the base frame for inputting process information;

an electronic control device forming a modular building block and attached to the base frame and electrically connected to the print apparatus and to the keyboard;

a power supply forming a modular building block and attached to the base frame and electrically connected to the electronic control device;

attachment means for modular building blocks disposed at the base frame, wherein the modular building blocks can be mounted to and demounted from the attachment means for modular building blocks;

attachment means for mounting and demounting of a function module selectable out of at least two functionally differing function modules wherein at least two functionally differing function modules are each interface-compatible relative to said attachment means for mounting and demounting;

two function modules capable of performing at least two differing functions with each of the two function modules adapted for attachment to the attachment means;

wherein the selectable function module is a journal printer provided with a print counter support attached in a journal printer frame with a parallel journal path for print substrate, with a cutting device for print substrate material, a multicolor ribbon cassette having an inked ribbon, a ribbon drive for an inked ribbon, an optical marking searcher for searching marks on a print substrate, a print head, with a print-head drive for said print head.

8. The printer according to claim 7, wherein the print substrate transport device includes several pairs of friction-drive rollers provided at the base frame and a step-drive motor with drive engaging at least one roller axis and disposed below the base frame and provided for the advance of the print substrate material.

9. The printer according to claim 7, wherein a selectable function module is formed by said journal printer attached to the base frame and disposed opposite to the power supply.

10. A printer for a plurality of different printing objects, wherein a base model (1) is formed, which comprises a base frame, a print apparatus (2) attached to the base frame, a print-object transport device (3) for transporting print substrate attached to the base frame, a keyboard (4) for entering commands attached to the base frame, an electronic control device (5) for controlling apparatus operation attached to the base frame, and a power supply (6) for providing power to the print apparatus attached to the base frame, where the print apparatus (2), the power supply (6), and the electronic control device (5), in each case, form modular building blocks (7), which modular building blocks (7) can be easily mounted and easily demounted based on receiver and bolting means (9, 10 or, respectively, 9*a*, 10*a*) disposed at the base frame (8) and wherein the base frame (8) is provided with additional receiver and bolting means (9, 10 or, respectively, 9*b*, 10*b*) for a function module, where the function module is selected from a group of function modules performing different functions, but replaceable against each other on the receiver and bolting means notwithstanding such difference of respective functioning;

wherein said base frame (18) includes sides (8*c*) and wherein the print apparatus (2) is provided with print head (40) having 18 pins and movable back and forth on the slide guide rods (42) with an automatic thickness compensating device (49) for compensating a thickness of a print substrate and is provided about at the distance of sides (8*c*) of the base frame (8) and where side walls (41*a*, 41*b*) are provided about in the distance of the sides (8*c*) of the base frame (8), which side walls (41*a*, 41*b*) are connected to each other with slide guide rods (42), where the print apparatus (2) is provided with a drive block (43) comprising an electric drive motor (44), a drive gear (45), and a cycle clock station (46) for sending signals for a print head control, a print head (40) and a multicolor inking ribbon cassette (39) insertable between the side walls (41*a*, 41*b*), which altogether form the print apparatus modular building block (7).

11. A printer according to claim 10, wherein the base model (1) comprises a demountable front cover cap (27) covering the print apparatus (2) and surrounding the keyboard (4) and a demountable rear cover cap (28) covering the power supply (6) and additional function modules (7).

12. Printer according to claim 10, wherein a rear cover cap (29) is provided for covering the print apparatus modular building block (2, 7), for protecting the power supply modular building block (6, 7) and a journal printer selectable function module (23, 7) and wherein a front cover cap 27 is provided joining at the rear cover cap.

13. Printer according to claim 10, wherein the base frame has a rear side and wherein an interface adapter slot (30) is provided at the rear side (8*a*) of the base frame (8).

14. Printer according to claim 10, wherein several pairs of friction-drive rollers (33, 34, 35) are provided at the base frame (8) and that a step-drive motor (37) with drive engaging at least one roller axis (36) and disposed below the base frame (8) is provided for the advance of the printing object.

15. Printer according to claim 10, wherein the base model (1) is expanded by a journal-printer selectable function module (23) disposed opposite to the power supply (6).

16. A printer for a plurality of different printing objects, wherein a base model (1) is formed, which comprises a base frame, a print apparatus (2) attached to the base frame, a print-object transport device (3) for transporting print substrate attached to the base frame, a keyboard (4) for entering commands attached to the base frame, an electronic control device (5) for controlling apparatus operation attached to the base frame, and a power supply (6) for providing power to the printer attached to the base frame, where the print apparatus (2), the power supply (6), and the electronic control device (5), in each case, form modular building blocks (7), which modular building blocks (7) can be easily mounted and easily demounted based on receiver and bolting means (9, 10 or, respectively, 9*a*, 10*a*) disposed at the base frame (8) and wherein the base frame (8) is provided with additional receiver and bolting means (9, 10 or, respectively, 9*b*, 10*b*) for a function module, where the function module is selected from a group of function modules performing different functions, but replaceable against each other on the receiver and bolting means notwithstanding such difference of respective functioning;

wherein the selectable function module is an optical character-recognition device (15) with a guide frame (50) comprising two parallel guide rods (51*a*, 51*b*), which are attached in a side plate (52*a*, 52*b*), and further including a drive (53) for a character recognition read head (54), which are disposed in a casing (55).

17. Printer according to claim 16, wherein the base model (1) is expanded by said optical character-recognition device (15) for recognizing characters on print substrate material disposed between the print apparatus (2) and the power supply (6) and expanded by a recognition electronic (32) disposed in a floor trough (8*b*) of the base frame and by a selectable function module.

18. A printer for a plurality of different printing objects, wherein a base model (1) is formed, which comprises a base frame, a print apparatus (2) attached to the base frame, a print-object transport device (3) for transporting print substrate attached to the base frame, a keyboard (4) for entering commands attached to the base frame, an electronic control device (5) for controlling apparatus operation attached to the base frame, and a power supply (6) for providing power to the print apparatus attached to the base frame, where the print apparatus (2), the power supply (6), and the electronic control device (5), in each case, form modular building blocks (7), which modular building blocks (7) can be easily mounted and easily demounted based on receiver and bolting means (9, 10 or, respectively, 9*a*, 10*a*) disposed at the base frame (8) and wherein the base frame (8) is provided with additional receiver and bolting means (9, 10 or respectively, 9*b*, 10*b*) for a function module, where the function module is selected from a group of function modules performing different functions, but replaceable against each other on the receiver and bolting means notwithstanding such difference of respective functioning;

wherein the base model (1) comprises a demountable front cover cap (27) covering the print apparatus (2) and surrounding and covering the keyboard (4) and a demountable rear cover cap (28) covering the power supply (6) and additional function modules (7);

the rear cover cap (29) is provided for covering the print apparatus modular building block (2, 7), for protecting the power supply modular building block (6, 7) and a journal printer selectable function module (23, 7) and wherein the front cover cap is provided joining at the rear cover cap (27);

the print apparatus (2) is provided with print head (40) having 18 pins and movable back and forth on slide guide rods (42) with an automatic thickness compensating device (49) and said thickness compensating device compensating print substrate thickness wherein sides (8*c*) are provided at the base frame (8) and wherein side walls (41*a*, 41*b*) are provided about in the distance of the sides (8*c*) of the base frame (8), which side walls (41*a*, 41*b*) are connected to each other with the slide guide rods (42), where the print apparatus (2) is provided with a drive block (43) comprising an electric drive motor (44), a drive gear (45), and a cycle clock station (46) for sender signals for a print head control, the print head (40) and a multicolor inking ribbon cassette (39) insertable between the side walls (41*a*, 41*b*), which altogether form a print apparatus modular building block (7);

wherein the selectable function module is an optical character-recognition device (15) with a guide frame (50) comprising two parallel guide rods (51*a*, 51*b*) and side plates (52*a*, 52*b*), which two parallel guide rods (51*a*, 51*b*) are attached in between the side plates (52*a*, 52*b*), and further including a drive (53) for a read head (54) for reading characters on a print substrate, which are disposed in a receiver casing (55); further comprising a second selectable function module is furnished as journal printer (23) provided with a print counter support (57) attached to a journal printer frame (56), with parallel journal paths (58, 59), with a cutting device (61) for a print substrate, multicolor inking ribbon cassette (60) having an inked ribbon, a ribbon drive (63) for said inked ribbon, an optical marking searcher (22) for searching marks on a print substrate, a journal print head (71) with a print head drive (72) for said journal print head (71).

19. A printer for a plurality of different print substrate material processing functions comprising a base frame having a side plate;

a print apparatus forming a modular building block and demountably attached to the base frame;

a print substrate material transport device disposed on the base frame;

a keyboard connected to the base frame for inputting process information;

an electronic control device forming a modular building block and attached to the base frame and electrically connected to the print apparatus and to the keyboard; a power supply forming a modular building block and attached to the base frame and electrically connected to the electronic control device;

attachment means for modular building blocks disposed at the base frame, wherein the modular building blocks are mounted to and demounted from the attachment means for modular building blocks;

two functionally differing function modules; attachment means disposed on the base frame for mounting and demounting of a selectable functionally differing function module;

a front cover cap mountable to and demountable from the base frame and covering the print apparatus and surrounding the keyboard;

a rear cover cap mountable and demountable from the base frame and covering a selectable function module, wherein the selectable function module is an optical character recognition device recognizing characters on a printer substrate material and provided with a guide frame comprising two parallel guide rods, which guide rods are attached in the side plate of the base frame, wherein said front cover cap connectingly joins at the rear cover cap;

a second selectable function module including a drive for a reading device, functioning as a read head of characters on a print substrate material, which reading device is disposed in a casing and, wherein the optical character recognition device and the casing containing the reading device form function modules.

20. A printer for a plurality of different print substrate material processing functions comprising a base frame;

a print apparatus forming a modular building block and demountably attached to the base frame;

a print substrate material transport device disposed on the base frame;

a keyboard attached to the base frame for inputting process information;

an electronic control device forming a modular building block and attached to the base frame and electrically connected to the print apparatus and to the keyboard;

a power supply forming a modular building block and attached to the base frame and electrically connected to the electronic control device;

attachment means for modular building blocks disposed at the base frame;

wherein the modular building blocks are mounted to and demounted from the attachment means;

attachment means for mounting and demounting of two alternative members selected from the group of function modules including an optical character-recognition device, a magnetic-strip processing unit, an optical line searching unit, an optical marking searcher, and a journal-printer modular building block, wherein the attachment means for mounting and demounting of two alternative members is provided by two sockets with a plurality of electrical contacts each disposed on a printed circuit board with an opening in the printed board for placing a print head disposed between the sockets and wherein the modular building blocks include each two plug sections matching the respective sockets and wherein a function element of the modular building block is disposed between the two plug sections.

21. A printer according to claim 20 further comprising a front cover cap mountable to and demountable from the base frame and covering the print apparatus and surrounding the keyboard; and a rear cover cap, mountable to and demountable from the base frame, covering the power supply and a selectable function module; further comprising a rear cover cap provided for covering the print apparatus modular building block, for protecting the power supply modular building block and a modular building block furnishing a journal printer; and a front cover cap for connectingly joining at the rear cover cap.

22. The printer according to claim 20, wherein the base frame has a rear side and further comprising an interface adapter slot provided at the rear side of the base frame.

23. The printer according to claim 20, wherein the selectable function module is an optical character-recognition device disposed on the base frame between the print apparatus and the power supply;

further comprising a casing floor trough disposed at the base frame, wherein said selectable function module is disposed in the casing-floor trough.

24. The printer according to claim 20 wherein the print apparatus is provided with a print head;

the base frame is provided with sides;

the print apparatus is provided at the distance of the sides of the base frame;

side walls are provided in the distance of the sides of the base frame, which side walls are connected to each other with slide guide rods;

the print apparatus is provided with a drive block comprising an electric drive motor, a drive gear, and a cycle clock station for sending signals for a print head control, said print head being movable back and forth on said slide guide rods with an automatic print substrate material thickness compensating device and a color-tape cassette insertable between the side walls, thereby altogether forming the print apparatus modular building block.

* * * * *